US005313671A

United States Patent [19]

Flory

[11] Patent Number: 5,313,671

[45] Date of Patent: May 24, 1994

[54] SWIM GOGGLES

[75] Inventor: Edmund L. Flory, Ketchum, Id.

[73] Assignee: Flory, Inc., Philadelphia, Pa.

[21] Appl. No.: 47,640

[22] Filed: Apr. 15, 1993

[51] Int. Cl.[5] ..... A61F 9/02

[52] U.S. Cl. ..... 2/428; 2/445; 2/450; 2/452; 24/662; 351/43; 351/126; 351/140; 351/149

[58] Field of Search ..... 2/428, 429, 430, 445, 2/450, 452; 351/43, 126, 128, 148, 149, 150, 133, 156, 124, 140, 121, 147; 128/858; 24/662, 585; 403/280

[56] References Cited

U.S. PATENT DOCUMENTS

| | | | |
|---|---|---|---|
| 2,103,575 | 12/1937 | Diggins | 351/126 |
| 2,545,428 | 3/1951 | Liautaud | 2/452 |
| 2,973,690 | 3/1961 | Lindblom | 351/133 X |
| 4,051,557 | 10/1977 | Bengston et al. | 351/43 X |
| 4,162,542 | 7/1979 | Frank | 2/446 X |
| 4,377,328 | 3/1983 | Ferrandi | 351/126 |
| 4,541,696 | 9/1985 | Winger et al. | 351/156 X |
| 4,818,094 | 4/1989 | Lyons | 351/156 X |
| 4,898,311 | 2/1990 | Boyer | 24/662 |
| 5,019,000 | 5/1991 | Stephens | 351/43 X |
| 5,110,198 | 5/1992 | Travis | 351/149 X |

FOREIGN PATENT DOCUMENTS

| | | | |
|---|---|---|---|
| 0460544 | 5/1928 | Fed. Rep. of Germany | 351/124 |
| 2340026 | 8/1977 | France | 351/121 |
| 3123314 | 5/1991 | Japan | 351/140 |

OTHER PUBLICATIONS

Webster, *Webster's New World Dictionary*, 1988, p. 110.

*Primary Examiner*—Peter Nerbun
*Attorney, Agent, or Firm*—Craig M. Bell

[57] ABSTRACT

An improved pair of swim goggles, especially designed for competitive swimming, is comprised of two substantially ovoid, convex lenses secured to a soft neoprene base. The goggles are simply and easily tightened about the head by a one pull toggle mechanism that provides an equal, balanced fit of the eye pieces against the face. The goggles provide less hydrodynamic resistance in the water during swimming and not only reduces fatigue by cutting down on eye strain but allows the swimmer both superior frontal and peripheral vision.

15 Claims, 3 Drawing Sheets

SWIM GOGGLES

FIELD OF THE INVENTION

The present invention relates generally to protective eyewear, more specifically, protective eyewear that is useful when worn during swimming so as to shield the eyes from water thereby allowing for a clear field of vision. The present invention particularly relates to protective eyewear for use during competitive swimming events.

BACKGROUND OF THE INVENTION

Competitive swimming is a demanding sport that requires full synchronization of all body parts if success is to be achieved. Victory can and is also often decided by fractions of a second and therefore every kick, stroke, and turn must be optimized to nearly perfect timing. Vital to the synchronization and timing is eyesight as clear perception of the visual patterns of the pool walls, ropes, and other swimmers is important so as to cue precisely when each critical movement must be made. This includes frontal vision for determining the distance to the pool wall for each turn and finish as well as peripheral awareness of the other swimmers and lane ropes.

The present invention is directed to an improved pair of hydrodynamically designed eye goggles that provide for increased frontal and peripheral vision as well as reduction in eye glare without increasing the resistance against the water surface.

U.S. Pat. No. 4,286,340 to Lathrop discloses swim goggles with improved peripheral vision comprised of a transversely curved front lens whose axis of curvature is inclined forwardly and downwardly with a flat side lens, the forward position of which flares into the curved lens. The outer portion of the circumferential wall of the upper lens is wide enough to avoid concentration of pressure on the eye yet narrow enough to fit comfortably within the narrower portion of the eye socket.

U.S. Pat. No. 4,051,557 to Bengston discloses eye goggles with improved eye comfort which eliminate eye distortion by having the seal of the eye piece moved out away from the eye sockets and onto the skull bone structure surrounding the eye.

U.S. Pat. No. 4,755,040 to Haslbeck also discloses swim goggles comprised of a pair of eye pieces, each eye piece having a lens with an essentially rigid peripheral frame. Each eyepiece has a seal holder and seal gasket, the seal holder being readily deformable but relatively stiff. This allows for a degree of resilience to accommodate certain larger curvatures of the face when present without excessive distortion. A softer material is also present to provide comfort and a yielding seal accommodates smaller variations in the curvature of the face.

Another variation on the same concept is disclosed in U.S. Pat. No. 5,046,199 to Hall which teaches a pair of sports goggles such as swim goggles which are characterized by the absence of any cushioning on the rear of the eyepieces. The nosepiece of the goggles has a flexible and resilient hinge-piece comprised of a dual lug and pin attachment combination which gives the nosepiece flexibility that enables it and the eyepieces to more closely conform to the face of the wearer, thereby doing away with the need for the eyewear cushioning.

U.S. Pat. No. 4,468,819 to Ohno discloses a pair of eye goggles wherein each lens is an integral piece of material comprising a dome-shaped ovoid transparent head that is integral with a relatively stiff frame and extends outwardly from the inner periphery thereof. The lens is provided with a flat outer surface which prevents the optical power from departing from a normal value. This asserted to be advantageous to swimmers in that the same focal length below and above water is maintained.

U.S, Pat. No. 4,977,627 to Metcalfe et. al., and U.S. Pat. No. 5,093,940 and No. 4,564,960 to Nishiyama et. al. disclose various embodiments of eye goggles with replaceable, adjustable lenses and head-straps. The lenses are generally attached to a flexible frame which is also the nosepiece whose distal ends are joined to head-straps for securing the goggles to the face. The lenses themselves are comprised of a flat, planar generally ovoid face that is tapered at the sides to conform to the curvature of the face.

Many, if not all of these swim goggles known in the art cause problems for the wearer that are inherent in their construction. Despite claims of flexibility, the nosepiece often cut the bridge of the nose and are difficult to adjust to a comfortable fit. Since most lenses have seams, the vision is distorted particularly when in the water. They do not provide a clear peripheral vision so as to give the swimmer as idea of where the competition is, and the seams in these lenses create a drag or resistance while moving through the water. This not only slows the swimmer down but tends to pull the goggles from the eye sockets thereby requiring repeated adjustments. Finally, the straps never seem to provide an evenly distributed, snug fit.

None of the swim goggles of the prior art solves the need for extended peripheral and frontal vision during competitions without requiring movement of the head either to the side, up or forward. Such movement then disturbs the smooth, timed synchronization of the body which can cost a swimmer a race. It is an object of the present invention to provide a flexible, hydrodynamically superior eye goggle for use in swimming that is constructed so as to allow for an unobstructed frontal and peripheral field of vision without requiring the wearer to move his head from side to side or forwards. Body alignment through the water is obviously a critical function of speed and is greatly affected by head movement which in turn directly affects efficient stroke mechanics. It is a further object of the present invention to provide a set of eye goggles that is snugly and comfortably secured to the face of the wearer by a one-pull strap that insures equal pressure by each eyepiece on the eye socket.

DETAILED DESCRIPTION OF THE INVENTION

Figure 1:
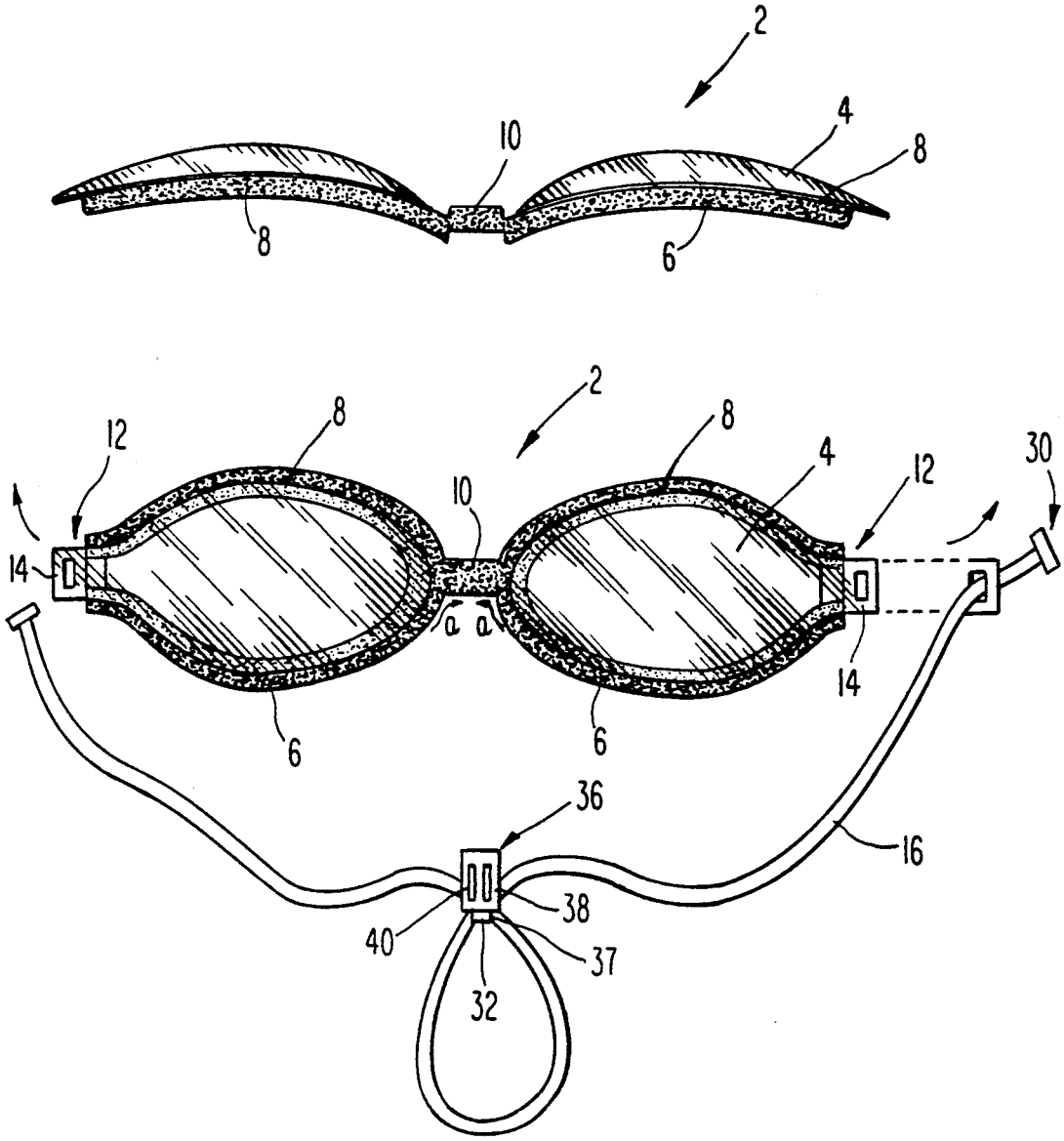
FIG. 1 is a frontal and top composite view of the eye goggles of the present invention.

The swim goggles of the present invention are comprised of a pair of seamless, generally ovoid-shaped curved lens symmetrically attached to a flexible, neoprene face engaging support that is secured about the wearer's face and head by a one-pull toggle adjusted strap. The seamless, ovoid-shaped lens are more hydrodynamic than anything known in the art and thereby provide less resistance in the water during a race. The surface of the lenses is substantially convex, in that it bends out away from the planar surface of the eye. The convex frontal surface coupled with the oval or tear-drop design of the seamless lens not only is distortion free, as opposed to the lenses known in the art which have at least one or multiple seams and/or ridges, but it also permits the swimmer greater peripheral and frontal vision when swimming. This not only allows the swimmer a superior field of vision to correctly judge the distance to the swimming pool wall so as to properly synchronize his strokes and take his turn but it also permits him to see the other swimmers so as to judge where he stands in relation to the competition. All of this can be done without requiring the swimmer to turn his head which would otherwise slow him down or foil his timing.

By cutting down on resistance in the water, the seamless, tear-drop shaped lens of the swim goggles of the present invention also cuts down on external hydrodynamic forces exerted by the water against the neck and shoulder muscles which can contribute to fatigue. This can be a crucial factor in longer, marathon-type races and during long periods of practice. The seamless, convex design of the lens also improves racing starts as there is less resistance by the lens when the swimmers head or face enters and slices through the water. Also, by providing both improved peripheral and frontal vision, there is no need to turn the head in order to pick up various visual cues such as distance to the pool wall and hence there is less likelihood for any disturbance in the stroke mechanics, body alignment, and timing.

Referring now to FIG. No. 1, the eye goggles 2 of the present invention consist of a pair of seamless, generally ovoid lenses 4 which conform to and are integral with a soft, neoprene support 6 that acts as a cushion to and engages the eye sockets of the wearers' face. The base edge of the lenses is formed into a lip 8 over which contacts the support 6 as the main surface area of the lens is convex and forms away from the eye socket. The lenses are preferably comprises of a UVAB tinted polycarbonate plastic for the reduction of the sun's harmful ultraviolet rays and the glare caused thereby in and off the water. This also allows the swimmer to better discern objects when partially shrouded in shadows or when the water is turbulent. Eye glare causes eye strain and is another factor that is directly responsible for fatigue so that cutting down this impediment is another important factor improving the swimmer's competitive edge.

The lip 8 about the periphery of the lens allows for each of the lenses to be secured directly to the rubberized neoprene base support 6. This attachment may be achieved by any number of means known in the art and may be glued, heat sealed, pressure sealed, or molded thereto. Whatever the means used, it is important that the lenses become integrally attached to the base with no gaps or points of separation. Such a bond insures a water-tight fit with none of the leakage problems that have so often plagued the swim goggles of the prior art.

Between the lens portion 4 of the swim goggles 2 is a nose piece 10 that is an integral part of the base support 6. As will be explained more definitively later on, the nose piece 10 bridges the nose of the swimmer when worn and provides a tension that counteracts that of the head-strap 16 and pulls the two lens portions inward (see arrow a) against the sides of the nose. This, combined with the opposite, lateral force exerted by the head-strap 16 serves to provide a tight, flush fit for the goggles against the face.

The head-strap 16 is connected to the goggles by any one of a number of means known in the art such as snaps, buckles, eyelet plugs, and the like, which are formed integrally with the base support 6 at its distal end 12. For example, as shown in FIG. 1, an eyelet plug 30 at the end of the head-strap 16 is passed through buckle 14 which, when the swim goggles are worn, hold the plug 30 when it is pulled tightly there against. This resilient tension then is transferred to the base support 6 as discussed supra, and, in conjunction with the nose bridge 10 serves to hold the goggles 2 flush with and tightly against the wearers' face.

Figure 2:
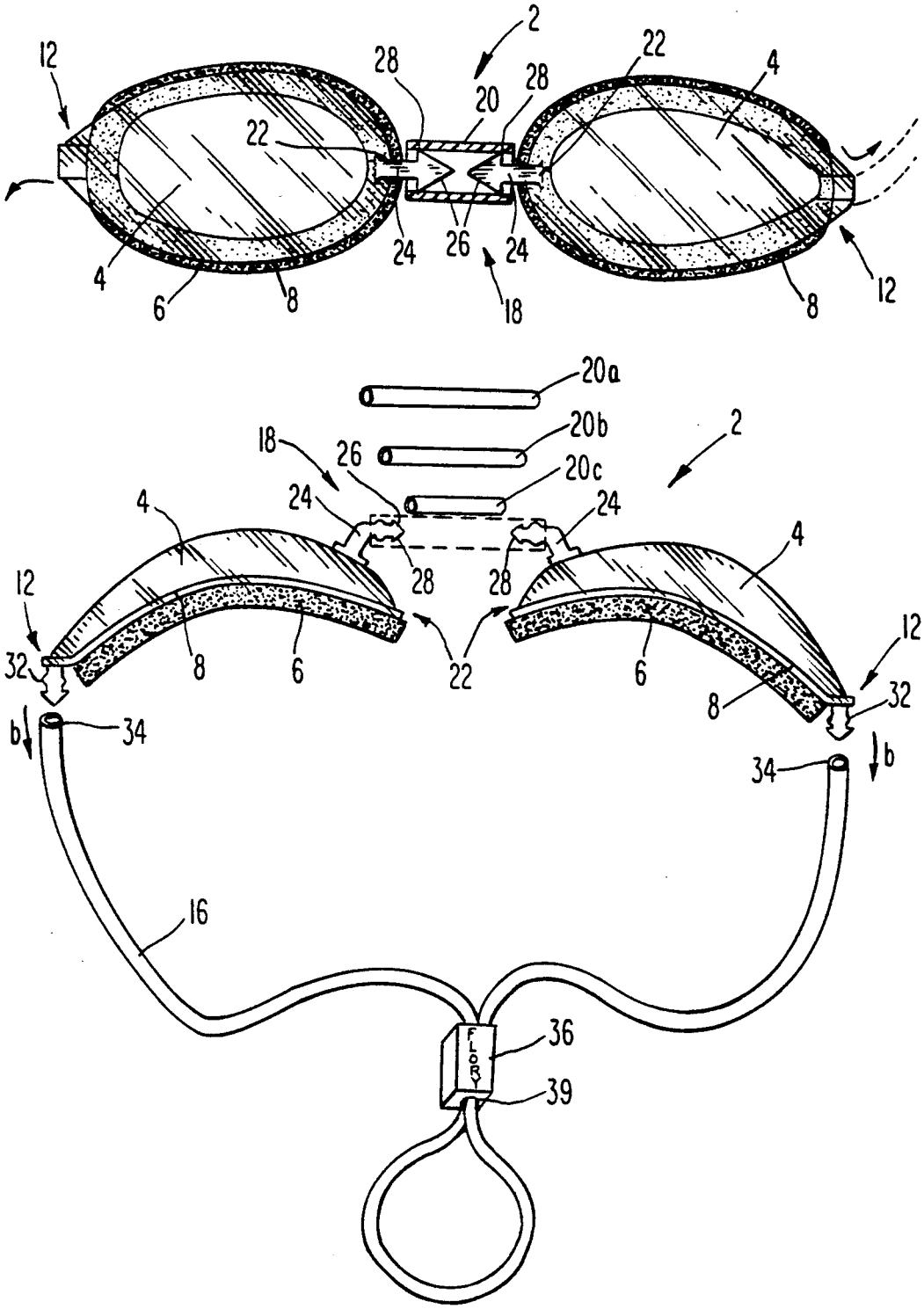
FIG. 2 is a frontal and an overhead, top view of the preferred embodiment of the goggles and adjustable side straps.
Figure 3:
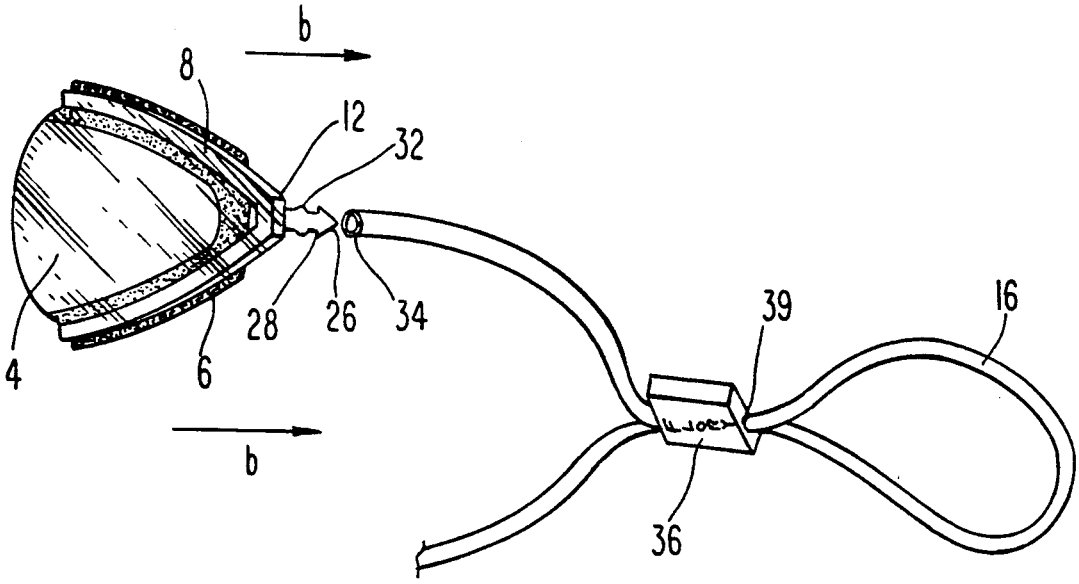
FIG. 3 is a side view of the preferred embodiment of the present invention

Referring now to FIGS. 2 and 3, the preferred alternative embodiments to the integral one-piece neoprene support construction of FIG. 1 is a two-piece construction in which the lens structures are connected by means of a nose-piece 18 comprised of a soft, resilient tubing 20 that may be adjustable in size according to the wearer's head. The tubular nose-piece 18 may be comprised of latex, synthetic rubber, or any other resilient, rubber-like material that connects the lenses 4 and supports 6 by attaching at their two proximal ends 22 to two (2) arrow-like posts 24 over which the tube 20 is fitted. The point 26 on each post 24 permits the rubber tube to be easily fitted thereover, but provides resistance against its' being pulled off. A barb-like point 28 on the end of each point 26 is easily pushed into the end of the tubing yet is not easily pulled out without considerable, deliberate exertion. Furthermore, once the post 24 is pressed into the tubing, an air tight suction is created providing additional strength to the bond between the nose-piece 18 and the neoprene base 6. This allows for the interchangeability of the nose-straps to conform to different sized nose bridges if worn by different swimmers or allows for their replacement when worn out.

As mentioned previously, the resiliency of the tubing of the nose-piece also functions to provide a tighter fit for the goggles against the face as it acts to pull the lens portions 4,6 tightly against the sides of the nose when worn. The eye goggles of the present invention then, create a duality of forces securing the eye lenses to the face. While head strap 16 provides a lateral force that pulls back against the face and out toward the temples (see arrows b), the rubberized nose-piece 20 is consequently stretched outward but its resiliency counters this force and pulls the lens flush with the inner bridge of the nose.

As a result, the lenses 4 provide a tight, yet comfortable fit about the eyes with less chance of water leakage then those goggles known in the art.

Referring again to FIG. 1, the swim goggles 2 are secured to the face by means of a tubular head strap 16 comprises essentially of the same plastic latex tubing that comprises the nose-piece 18. The ends 30 of the head-strap 16 are secured to the corners or distal ends of the goggles 12 by any one of a number of means known in the art. As before, this can comprise buckles, snaps, eyelet-plugs, and the like. Preferably, as seen in FIGS. 2 and 3, pointed posts 32 similar to those 24 that secure the nose-guard 18 are an integral part of either the lens 4 or the neoprene support material 6 and as before, are firmly inserted into the tube ends of the strap 16 so as to not release it when pulled. As with the nose-piece 18, this is firmly secured by both the barbed point 28 and the air tight suction created when the post 32 is pressed into the head-strap 16 tubing. These posts 32 may be either co-molded as an integral part of the lens at its distal ends 12 as shown in FIGS. 2 and 3 or may be molded separately and attached to either the lens or the support by any one of a number of methods known in the art. For example, the distal ends 12 of the lens 4 or support 6 may be provided with a small hole, into which post 34 is inserted.

Referring again to FIG. 1, the head-strap 16 is easily tightened about the head in a one handed, single pull fashion which is made possible through the use of a simple toggle lock 36 which is pulled flush against the back of the head thereby tightening the circumference of the head-strap 16 that goes around the head and consequently holds the goggles more forcibly against the face and eyes. This provides the lateral forces against the nose-piece 10 discussed supra. The toggle 36 may comprise essentially a spring-biased post 37 with a hole that fits within a larger post 38, also with a hole 40. The spring bias is maintained within the larger outer post 38. The holes of the inner post 37 are aligned with the holes of the outer post 38. The spring bias mechanism of the toggle button 32 however, urges the inner holes out of alignment so as to pinch and hold the head-strap 16 preventing further movement of the strap through the holes without compression or compaction of the toggle 36 to realign the holes. By pushing or squeezing the button 32 of the inner post 37 of the toggle 36, the holes become re-aligned and the head-strap 16 is no longer pinched by the toggle 36 and maybe readily released or tightened.

Referring now to FIG. 2, the toggle 36 may also comprise a more simple one-post configuration wherein the post is provided with a hole 39 slightly smaller than the circumference of the head-strap 16. The head-strap 16 is then squeezed through the hole, thereby compressing the strap within. This compression force translates into an outward tension that enables the one piece toggle 36 to secure the strap about the head. In either toggle embodiment, the loosening or tightening of the strap 16 is a simple, one pull mechanism which can be done easily by the squeeze and pull of the toggle using one hand just prior to a race. This also allows for the swimmer to control the pressure of the goggles around the eyes when in use and can be easily tightened or adjusted during long races without affecting the swimmer's stroke or rhythm. For marathon or tri-athletes, this is particularly important since the numerous adjustments that must normally be made during a long race cumulatively amounts to a considerable time factor. This simple one pull method enables these adjustments to be made without disruption in rhythm and thereby reduces those factors which impede a swimmers speed.

Another important advantage achieved by the toggle lock head-strap combination is that it allows for an equal, balanced fit of the goggles against the face of the wearer. In other words, by providing a single locking mechanism at a point on the strap that is equidistant from both of the distal ends 12 of the strap and lens, the lateral force discussed earlier that is exerted by the strap thereby pulling the lens and support flush against the face will be equivalent at both eye sockets. This together with the counter force supplied by the nose piece 18 will thereby insure a more secure, watertight fit with less chance of the goggles sliding off the face during competition.

It is recognized that numerous minor changes and alterations can be made to the eye-goggles of the present invention which are not depicted in the drawings or described herein. It is to be understood that those changes which do not materially alter the overall gist of the present invention fall within its spirit and scope as defined by the following claims.

What is claimed is:

1. A pair of swim goggles comprising:

a) a seamless ovoid and convex-shaped pair of lenses, b) a pair of barbed pointed posts having base portions attached to said pair of lenses;

c) a nose piece comprising resilient tubing, said pair of barbed pointed posts being disposed within the end portions of said resilient tubing, d) a substantially flexible support for symmetrical containment of said lenses, and;

e) a head-strap attached at the distal ends of said support for securing said goggles to a face of a wearer.

2. The swim goggles of claim 1 wherein said flexible support is a one piece construction comprised of a material selected from the group consisting of rubberized neoprene foam.

3. The swim goggles of claim 2 wherein said lenses are comprised of UVAB protected polycarbonate plastic.

4. The swim goggles of claim 1 wherein said support is comprised of two separate eye-piece portions for containment of said lenses that are joined by the flexible nose piece.

5. The swim goggles of claim 4 wherein said tubing is comprised of a material selected from the group consisting of synthetic rubber, latex, and mixtures thereof.

6. The swim goggles of claim 5 wherein said posts are integrally attached to said lenses by way of said neoprene support base.

7. The swim goggles of claim 6 wherein said head-strap further comprises a toggles lock for securing said swim goggles about the head of the wearer.

8. The swim goggles of claim 7 wherein said support consists of a rubberized neoprene foam base, and said lenses are integrally attached thereto by means of a lip above the outer periphery of said lens.

9. The swim goggles of claim 8 wherein said head-strap can be tightened or loosened using one hand of the wearer.

10. The swim goggles of claim 9 wherein said head strap when tightened about the head of the wearer provides the lenses and support with a symmetrically balanced water-tight fit about the eyes of the wearer.

11. An improved pair of competition swim goggles comprising seamless, substantially symmetrical, ovoid-shaped lenses maintained in an eye-engaging spatial relationship by means of a one piece neoprene foam support that is secured to the face of the wearer by a toggle lock tightened head-strap, and a resilient nose piece comprised of rubberized tubing and a pair of barber pointed posts that are attached to said lenses, said rubberized tubing being pulled over said pair of barbed posts.

12. The swim goggles of claim 11 wherein said nose piece is comprised of a material selected from the group consisting of synthetic rubber, soft plastic, latex and mixtures thereto.

13. The swim goggles of claim 12 wherein the periphery of said lenses comprise a lip which is integrally attached to said support thereby securing them in said eye-engaging spacial relationship.

14. The swim goggles of claim 13 wherein said lenses are comprised of UVAB protected polycarbonate plastic.

15. The swim goggles of claim 14 wherein said headstrap, when securely tightened about the head of the swimmer during use, acts in conjunction with said nose piece to provide the support of the goggles with a symmetrically balanced, water tight fit about the eyes of the wearer.

* * * * *